United States Patent [19]

Laub, III

[11] Patent Number: 4,534,477

[45] Date of Patent: Aug. 13, 1985

[54] ONE-PIECE CHILDPROOF TAMPER-EVIDENT BOTTLE AND CAP

[76] Inventor: Herman Laub, III, 244 N. San Marino, San Gabriel, Calif. 91775

[21] Appl. No.: 583,886

[22] Filed: Feb. 27, 1984

[51] Int. Cl.[3] ..... B65D 55/02

[52] U.S. Cl. ..... 215/215; 215/217; 215/218; 215/330; 215/250; 215/252

[58] Field of Search ..... 215/215, 216, 217, 218, 215/330, 250, 252

[56] References Cited

U.S. PATENT DOCUMENTS

| | | | |
|---|---|---|---|
| 2,921,705 | 1/1960 | Dorsey | 215/215 |
| 3,610,454 | 10/1971 | Malick | 215/330 |
| 4,032,028 | 6/1977 | Reiss et al. | 215/217 |
| 4,289,248 | 9/1981 | Lynn | 215/330 |

*Primary Examiner*—George T. Hall

*Attorney, Agent, or Firm*—Peter I. Lippman

[57] ABSTRACT

This bottle has a projection or "latch" from its neck, just below the thread, and along and near the lower end of that thread. There is a gap in the cap thread, that lines up with the "latch" when the cap is fully screwed on. The cap deforms when screwed on, passing the "latch" over the end of the cap thread and into the gap. The "latch" then resists cap removal. Only torque beyond the ability of a small child (or even requiring use of a tool) frees the cap. A second projection from the neck, a "flag", is breakable. It is below the bottom end of the neck thread, just above (measured along the thread) the "latch". The "flag" can fold against the neck, but springs out if released. It catches in the cap-thread gap when the cap is unscrewed, and is torn off or broken by forcible removal of the cap. Its removal or breakage evidences that the bottle has been opened.

13 Claims, 4 Drawing Figures

ONE-PIECE CHILDPROOF TAMPER-EVIDENT BOTTLE AND CAP

BACKGROUND

1. Field of the Invention

This invention relates generally to bottle-and-cap systems; and more particularly to provision of childproof caps, and to provision of containers whose prior opening is rendered permanently conspicuous.

2. Prior Art

Many systems have been devised for preventing access by small children to bottles containing medicine or other substances. Most of these systems involve use of compound motions—such as pushing down on a cap while unscrewing it, or first rotating a cap to a certain angular position and then unsnapping it.

A typical complaint regarding these systems is that children seem to be able somehow to defeat them and open the containers, while adults—particularly adults with failing eyesight, failing manual dexterity, or failing mental acuity, but also adults who simply do not have a great deal of aptitude for mechanical gadgetry—have considerable difficulty opening the containers. In fact, the difficulty is so great that most pharmacies now offer all their patrons a choice between childproof and "non-childproof" containers! Needless to say, this additional complication of commerce, and of the everyday lives of the elderly, is highly undesirable.

Another disadvantage of these systems is that many of them require two-part (or multipart) construction of the covers. The internal snap ring or guide ferrule adds substantially to the overall cost of such a container system. Worse yet, these compound constructions introduce an element of manufacturing tolerances—and thereby an element of uncertainty and aggravated frustration: when a cover cannot be removed, there is no way to tell whether it is the hapless adult or the invisible but apparent inner guide ring that is at fault.

Dealing with the protection of children from their own curiosity is a difficult enough problem, but this problem is exacerbated by a further complication of modern packaging—the phenomenon of deliberate tampering with medicines, foodstuffs and the like by sadistic or otherwise mismotivated individuals. In recent years there have been many instances of apparently intentional contamination of medicine and food inventories by poison, animal droppings, and other kinds of offensive, dangerous or lethal foreign substances.

Numerous types of extra shrink-on wrappings, breakable wire or plastic rings, and the like have been devised to make it apparent whether prior opening of a container has occurred. These systems add monumental manufacturing complexity and cost, which of course are clearly an enormous social waste since only a tiny fraction of a percent of all such containers are ever subject to tampering. Worse yet, to make these "tamper-evident" systems really work it is necessary to make them at least slightly resistant to removal, and this adds further to the annoyance of the elderly and the nonmechanical alike in gaining access to their medicines, foodstuffs, and other needed supplies.

SUMMARY OF THE DISCLOSURE

My invention provides a one-piece cap that requires no compound motion for removal, and whose prior removal is evident. No extra wrappings, interlocked rings or bands, or other separate pieces are required to make tampering conspicuous; rather, only the one-piece cap and a one-piece container suffice. Furthermore, the tooling for molding the cap and bottle are not significantly more expensive than tooling for conventional caps and bottles, and there is no significant added expense in sealing the cap to the bottle.

My invention proceeds from the observation that the psychology of prior-art childproof and tamper-evident containers is misdirected. These prior-art systems apparently have been inspired by the conviction that small children are less observant, clever, mechanically insightful, and dextrous than adults. It is a commonplace that at least the first three of these convictions are false; and the fourth conviction is defeated by the tendency of children (as contrasted with adults) to be markedly curious and exceedingly persistent.

On the other hand, what has been overlooked in the psychology of prior-art childproof and tamper-evident containers are these facts:

(1) Most small children have far, far less hand strength than most adults—even elderly, infirm adults with failing eyesight, failing manual dexterity or failing mental acuity.

(2) An elderly person may have a great deal of difficulty mastering a compound motion that is a new one—not learned at a time when the person was more in tune with learning new skills—and particularly so when the motion is directed to manipulating a mechanical device that is hidden, shielded from view by an outer shell of the container cover.

The same person may be able to cope very effectively with a somewhat complicated motion that is quite familiar from the time of teenage activities onward, and that is conducted with all the interacting parts in plain view.

(3) Most small children's hands are far smaller than those of most adults, so that it is far more difficult for small children to perform operations that require holding both a container and a tool together in a particular orientation with one hand while they manipulate a remote end of the tool with the other hand—even if they correctly perceive or deduce that such activity is required.

Accordingly my invention relies simply on requiring application of more torque to remove a cover than most small children can apply.

For those containers in which it is appropriate, my invention relies also on the use of a tool—specifically, any generally straight edge such as a narrow screwdriver, the back edge of a butterknife, etc.—to apply leverage, to bring the torque far above that which a small child can apply. Although this manipulation is within the intellectual capacity of small children, it will not generally be within their physical capacity since it requires larger hands and, again, greater torque, than are at their disposal.

Another type of tool that can be used is a fixed straightedge, such as the blunt edge of a car door. Although this sort of tool does not require adult-size hands, it does require substantially more torque on the bottle than small children generally will be able to supply.

With these principles in mind I shall now describe my invention in general terms.

1. THE CHILDPROOF BOTTLE AND CAP

My invention provides a combination of a bottle and a cover for use in containing products. The bottle is adapted to contain such products, and it has a neck, and a generally helical outwardly projecting thread defined in the outer surface of the neck. There is an outward projection from the neck, immediately above or below a particular segment of the helical thread. This projection will sometimes be called a "latch" in this document.

The invention also includes a cap that is adapted to block passage of products from the bottle, and that has a generally cylindrical body and an end wall closing the upper portion of the cylindrical body. Although most caps are generally cylindrical on the outside as well as the inside, some caps have noncylindrical shapes for decorative or other reasons. It will be understood that the outer surfaces of the body may be given other shapes without departing from the spirit of my invention, so long as the inner surface of the body is generally cylindrical.

The cap also has a generally helical inwardly projecting thread defined in the inner surface of the cylindrical body. This thread is adapted to mate with the outwardly projecting thread defined in the outer surface of the neck, to removably secure the cap to the neck. In addition there is a gap in a particular segment of the inwardly projecting thread. This gap is at a location that corresponds, when the cap is substantially fully threaded onto the bottle, to the location of the outward projection from the neck of the bottle.

The outward projection from the neck of the bottle is preferably immediately above or below the helical thread defined in the neck, and is near the lower end of that helical thread (as measured along the length of the helix). Correspondingly, the gap in the helical thread defined in the inner surface of the cylindrical cap body is preferably near the lower end of that latter thread.

By virtue of this configuration of bottle and cap, the outward projection from the neck of the bottle enters the gap in the inwardly projecting thread, when the cap is substantially fully threaded onto the bottle, and obstructs removal of the cap from the bottle. The parts are readily made, however, so that application of a certain amount of torque to the cap overcomes the obstruction presented by the cap, deforming the cap so that the outward "latch" projection passes over the tail end of the cap thread, freeing the cap for removal.

Based on the principles delineated earlier, it will be understood that my invention also encompasses provision of some means—generally a suitable contour defined in the cap—for accommodating a tool to facilitate forcible removal of the cap from the bottle.

The features just described provide a one-piece cap and one-piece bottle that are reasonably childproof but readily opened by nearly all adults.

2. THE TAMPER-EVIDENT BOTTLE AND CAP

Now as to provision of tamper-evident packaging, my invention also includes a bottle that is adapted to contain products and that has a neck and a generally helical outwardly projecting first thread defined in the outer surface of the neck. There is a thin, frangible and conspicuous outward projection from the neck, below the lower end of the first helical thread. This frangible projection, sometimes called the "flag" in this document, is adapted to be folded substantially flat against the outer surface of the neck.

The frangible "flag" is resilient. Consequently, when folded substantially flat against the outer surface of the neck, it has a tendency to spring outwardly toward a more outwardly projecting orientation.

This aspect of my invention also provides a cap that is adapted to block passage of such products from the bottle, and that has a generally cylindrical body (subject to the previously stated qualification) and an end wall closing the upper portion of the cylindrical body.

A generally helical inwardly projecting second thread is defined in the inner surface of the cylindrical body, and is adapted to mate with the first thread, to removably secure the cap to the neck and to hold the frangible "flag" projection flat against the outer surface of the neck.

There is a gap in a particular segment of the second thread, at a location that is slightly above (as measured along either helical thread when the cap is fully threaded onto the neck) the location of the "flag".

By virtue of these features, when the cap after having been substantially fully threaded onto the bottle is unscrewed slightly, the frangible outward projection enters the gap in the second thread, tending to obstruct removal of the cap, and is torn off by the second thread in the course of continuing forcible removal of the cap from the bottle.

3. THE CHILDPROOF, TAMPER-EVIDENT BOTTLE AND CAP

It is to be further understood that the gap in the cap thread mentioned in subsection 1 above, and the gap in the cap thread mentioned in subsection 2 above, may be one and the same. Hence one cap-thread gap may serve both (1) to seat the "latch" projection that makes the system childproof, and (2) to catch and tear off or damage the "flag" projection that makes the system tamper-evident.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
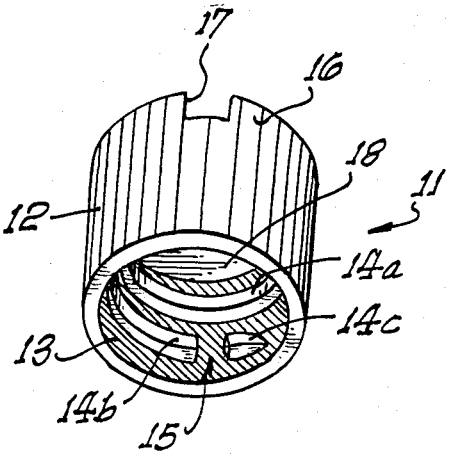
FIG. 1 is an isometric view, from below, of a cap according to a preferred embodiment of my invention.

As seen in FIG. 1, my invention provides a bottle cap 11 that has a generally cylindrical body 12, with inner cylindrical surface 13. The cap body is referred to for convenience as generally cylindrical, though it will be understood that of course the outer surface 12 may be square, hexagonal, or entirely irregular or arbitrary in shape as is common in decorative or novelty caps.

The cap has a transverse end-wall 18 that prevents escape of substances from the bottle via the cap. Defined on the inner surface 13 of the cap body is a helical thread, of which three segments are visible in FIG. 1: segments 14*a*, 14*b* and 14*c*. Two of these segments 14*b* and 14*c* are near the very extreme end 14*c* of the helical thread, and are separated by a gap 15.

The precise shape of the end walls that define this gap 15, and particularly (1) the slope of the end wall that is toward the extreme end segment 14*c*, and (2) the height of that end wall, are important in controlling the amount of torque required to remove the cap from the bottle. Determination of this shape requires careful attention, but a suitable shape will be found with only a slight amount of trial and error—once the fact is realized that the steeper the slope and height, the greater the required torque.

It is really impractical to specify optimum values in a document of this type, because there is so much variation with the materials, wall thicknesses, and general construction of the cap 11 and bottle neck 21—as well as the age of the children who are to be kept from opening the bottle. Hence these values are left to routine production design, but design guided by the principles stated here.

Also important to practice of my invention, but similarly subject to myriad variables and accordingly best established by just a little trial and error, is the shape of the uppermost surface of the helical thread 14*a*-14*b*-14*c*. In particular, it is desirable that the end segment 14*c* be tapered upwardly in height, from the rightmost (as drawn in FIG. 1) point where it begins, rising as it progresses leftwardly to the end wall that defines one end of the gap 15. The end segment 14*c* may also be advantageously made slightly shallower than the other segments 14*a* and 14*b* of the helical thread. The purpose of this taper and lesser height will be explained shortly.

Figure 2:
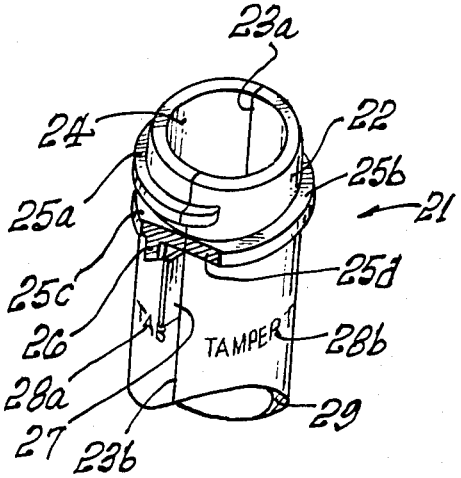
FIG. 2 is an isometric view, taken from above and partly in section, of the neck of a bottle according to preferred embodiments of my invention.

FIG. 2 shows the neck 21 of a bottle drawn interrupted as at 29 since the remainder of the bottle is generally conventional, and its details are not of particular concern to an understanding of my invention. My invention particularly contemplates bottles (and caps) made of molded plastic, though other materials and modes of manufacture may be encompassed within the scope of my invention.

The neck has outer surface 22 and inner surface 24, and as is typical with molded bottles has a flash line or parting line 23*a* at one side of the bottle and 23*b* at the other. Formed in the outer surface 22 of the neck 21 is a continuous helical thread, with segment 25*a*, and subsegments 25*b* and 25*c*, visible in the drawing. Between the subsegments 25*b* and 25*c* the thread has been drawn cut away and in cross-section, for a clearer view of two features that are immediately below the lowermost segment (25*b*-25*c*).

Figure 3:
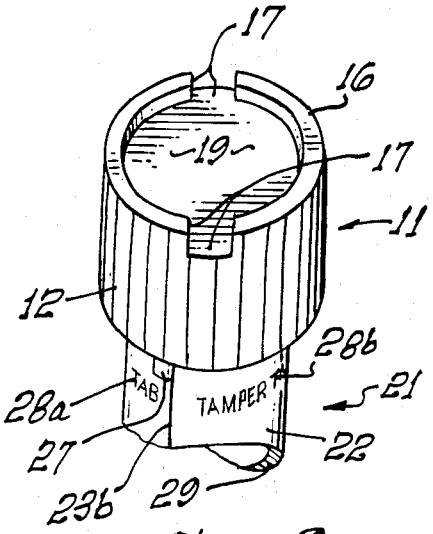
FIG. 3 is a view similar to FIG. 2, but showing the FIG. 1 cap installed on the FIG. 2 bottle.

Formed integrally with the helical thread and immediately below its segment 25*d* is a "latch" projection 26. When the cap 11 of FIG. 1 is fully screwed onto the bottle neck 21 of FIG. 2—as shown in FIG. 3—this "latch" projection fits into the gap 15 (FIG. 1) between thread segments 14*b* and 14*c* on the inner surface 13 of the cap body. Although it is not absolutely essential that the "latch" 26 be integral with the helical thread 25*a*-25*b*-25*c*, such construction is preferred for the added strength imparted to the "latch" 26.

As previously mentioned, the taper and the lesser height of the end segment 14*c* will have the advantageous effect of facilitating the fastening of the cap to the bottle—and facilitating not only the initial fastening by the packager, but also the refastening by the consumer. It may now be understood that this facilitation results from the tendency of the "latch" 26 to ride up the taper of the cap-thread end segment 14*c* (FIG. 1), forcing a slight deformation of the cap (and also of the bottle neck), and thereby permitting the "latch" 26 to be very easily moved over the end segment 14*c* and into the gap 15.

It has already been pointed out that the shape and height of the end-wall of the cap-thread segment 14*c* are important in calibrating or establishing the torque level required to start the unthreading of the cap 11 from the bottle neck 21. Similarly the shape and height of the more-counterclockwise end face (as drawn in FIGS. 2 and 4) of the "latch" 26 also participate in determining that torque level. These parameters should be determined with a brief amount of trial and error, bearing in mind that a steeper slope and greater height of the "latch" 26 tend to increase the required level of cap-removal torque.

As shown in FIG. 3, the upper surface 19 of the end wall (18 in FIG. 1) may be recessed slightly so that the upper periphery of the cap body forms an upstanding ridge 16. This ridge 16 may be interrupted at two or more points to form slots or notches 17, for accommodation of a torquing tool (not illustrated) such as a small screwdriver blade, the handle of a spoon or the back edge of a blunt butterknife, or in an automotive environment the blunt edge of a car door.

Figure 4:
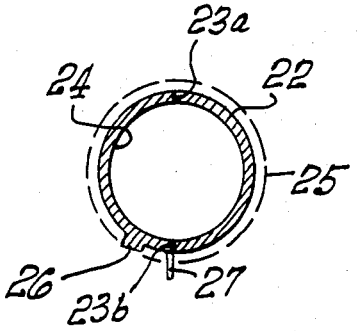
FIG. 4 is a plan view of the FIG. 2 bottle neck, almost entirely in section, taken at a height that is immediately below the lowermost segment of the helical thread on the neck.

FIGS. 2 and 4 also show an outwardly projecting "flag" projection 27, which may advantageously be formed at the flash line 23*b* for a particularly convenient but effectively fragile configuration. (FIG. 4, being taken looking downwardly from a height just below the lower end of the helical thread formed in the bottle neck, cannot actually include the thread itself. For reference purposes, however, the downward projection of that thread is shown in phantom at 25.)

The "flag" 27 must be readily frangible—that is to say, easily torn, or easily torn off or broken off from the bottle neck 21. The "flag" 27 also should be readily folded down flat against the outer surface 22 of the bottle neck 21, so that when the cap 11 is installed on the neck 21, the "flag" 27 is captured between the cap 11 and neck 21. When this is done, the "flag" 27 is held flat between the cap and neck, preferably (for most purposes) with the lower end of the "flag" 27 visible below the bottom edge of the cylindrical body 12 of the cap 11 as illustrated in FIG. 3.

When the bottle is to be opened, as previously explained sufficient torque must be applied to force the end segment 14*c* of the cap thread over the "latch" projection 26 (or stated otherwise, to force the "latch" 26 out of the gap 15 and over the end segment 14*c*). Once the end segment 14*c* has moved past the "latch" 26, the gap 15 will move into position over the frangible "flag" 27, allowing the "flag" 27 to spring outwardly so that it tends to obstruct the movement of the previously mentioned end wall of the gap 15—i.e., so that the "flag" tends to obstruct the end segment 14*c*.

This obstruction is slight, however, in view of the fragility of the "flag" 27. The advancing end segment 14c will break, tear, or otherwise damage the "flag" 27—possibly tearing it off entirely, but in any event preferably damaging it so that it cannot be readily made to appear undisturbed. The bottle will thus be opened, but the damage to the "flag" will make plain that the bottle has been subject to tampering and in particular to prior opening.

For some special purposes such as military security systems it may be preferable to refrain from alerting a would-be tamperer that the bottle and cap are tamper-evident. In such a case, the "flag" 27 may simply be made shorter in the vertical direction so that its lower end is concealed by the bottom edge of the cap 11.

In most cases, however, it is desirable to warn the tamperer as well as the consumer that the bottle and cap are tamper-evident. In these cases, not only should the "flag" 27 be long enough to show below the bottom edge of the cap 11 when the cap is fully installed, but in addition the bottle neck (and the cap, if desired) may advantageously be printed with conspicuous indicia 28*a*, 28*b* calling attention to the "flag" 27 and explaining its significance.

In addition, if desired, the inner surface 13 of the cap 11, in the vicinity of the gap 15 and thread end segment 14*c*, may be provided with a sharp, serrated, or otherwise damaging projection or area which lacerates or crumples the "flag" 27, or otherwise renders the "flag" 27 conspicuously damaged.

I have described my invention in terms of outward projections from the bottle neck, in conjunction with a gap in the inwardly projecting cap thread. I intend, however, to encompass within the scope of my invention the provision of inward projections from the cap, in conjunction with a gap in the outwardly projecting neck thread.

To some degree these two embodiments of my invention may be intermixed—as for example, by having the "latch" projection extend inwardly from the cap while the "flag" projection extends outwardly from the neck, or vice versa. In these mixed embodiments it is necessary to provide two different thread gaps: one in the cap thread, to engage the outward projection from the neck, and the other in the neck thread, to engage the inward projection from the cap. Nevertheless all these variants are equivalent to the embodiments particularly illustrated and described, and hence are within the scope of my invention.

It is to be understood that all of the foregoing detailed descriptions are by way of example only, and not to be taken as limiting the scope of my invention—which is expressed only in the appended claims.

I claim:

1. In combination for use in containing products, a bottle-and-cap combination that resists being unsealed and opened, from a fully-threaded-on position, but that can be unsealed and opened by application of torque exceeding the level that can generally be exerted by children; said combination comprising:

a bottle that is adapted to contain such products and that has:

a neck, a generally helical outwardly projecting thread defined in the outer surface of the neck, and an outward projection from the neck, immediately above or below a particular segment of the helical thread; and a cap that is adapted to block passage of such products from the bottle, and that has:

a generally cylindrical body, an end wall closing the upper portion of the cylindrical body, a generally helical inwardly projecting thread defined in the inner surface of the cylindrical body and adapted to mate with the outwardly projecting thread defined in the outer surface of the neck, to removably secure the cap to the neck, and a gap in a particular segment of the inwardly projecting thread, at a location that corresponds, when the cap is substantially fully threaded onto the bottle, to the location of the outward projection from the neck of the bottle;

the cap being substantially fixed axially with respect to the bottle by the mating threads when the cap is substantially fully threaded onto the bottle;

wherein the outward projection from the neck of the bottle enters the gap in the inwardly projecting thread, when the cap is substantially fully threaded onto the bottle, and obstructs starting of the removal of the cap from the bottle away from such fully-threaded-on position unless unthreading torque is applied which exceeds a level that can generally be exerted by most children;

the cap substantially blocking passage of products when it is obstructed by the inward projection from the neck; and wherein the otuward projection from the neck of the bottle does not effectively resist starting of the removal of the cap from the bottle if unthreading torque is applied which exceeds a level that can generally be exerted by most children but which is readily exerted by most adults.

2. The combination of claim 1, also comprising:

means defined in the cap for accommodating a tool to facilitate forcible removal of the cap from the bottle.

3. The combination of claim 1, wherein:

the outward projection from the neck of the bottle is immediately above or below the helical thread defined in the neck, and is near the lower end of the helical thread defined in the neck; and the gap in the helical thread defined in the inner surface of the cylindrical cap body is near the lower end of the helical thread defined in the inner cylindrical cap body.

4. In combination for use in containing products, a bottle-and-cap combination that resists being unsealed and opened, from a fully-threaded-on position, but that can be unsealed and opened by application of torque exceeding the level that can generally be exerted by children; said combination comprising:

a bottle that is adapted to contain such products and that has:

a neck, a generally helical outwardly projecting thread defined in the outer surface of the neck, and a gap in a particular segment of the outwardly projecting thread; and a cap that is adapted to block passage of such products from the bottle, and that has:

a generally cylindrical body, an end wall closing the upper portion of the cylindrical body, a generally helical inwardly projecting thread defined in the inner surface of the cylindrical body and adapted to mate with the outwardly projecting thread defined in the outer surface of the neck, to removably secure the cap to the neck, and an inward projection from the inner surface of the cylindrical body, immediately above or below a particular segment of the inwardly projecting thread, at a location that corresponds, when the cap is substantially fully threaded onto the bottle, to the location of the gap in the thread that is defined in the neck of the bottle;

the cap being substantially fixed axially with respect to the bottle by the mating threads when the cap is substantially fully threaded onto the bottle;

wherein the inward projection from the inner surface of the cylindrical cap body enters the gap in the outwardly projecting thread, when the cap is substantially fully threaded onto the bottle, and obstructs starting of the removal of the cap from the bottle away from such fully-threaded-on position unless unthreading torque is applied which exceeds a level that can generally be exerted by most children;

the cap substantially blocking passage of products when it is obstructed by the inward projection from the neck; and wherein the inward projection from the neck of the bottle does not effectively resist starting of the removal of the cap from the bottle if unthreading torque is applied which exceeds a level that can generally be exerted by most children but which is readily exerted by most adults.

5. The combination of claim 4, also comprising:

means defined in the cap for accommodating a tool to facilitate forcible removal of the cap from the bottle.

6. The combination of claim 4, wherein:

the outward projection from the neck of the bottle is immediately above or below the helical thread defined in the neck, and is near the lower end of the helical thread defined in the neck; and the gap in the helical thread defined in the inner surface of the cylindrical cap body is near the lower end of the helical thread defined in the inner cylindrical cap body.

7. In combination for use in containing products:

a bottle that is adapted to contain such products and that has:

a neck, a generally helical outwardly projecting first thread defined in the outer surface of the neck, and a thin, frangible and conspicuous outward projection from the neck, below the lower end of the first helical thread, adapted to be folded substantially flat against the outer surface of the neck, said frangible outward projection having, when folded substantially flat against the outer surface of the neck, a tendency to spring outwardly toward a more outwardly projecting orientation; and a cap that is adapted to block passage of such products from the bottle, and that has:

a generally cylindrical body, an end wall closing the upper portion of the cylindrical body, a generally helical inwardly projecting second thread defined in the inner surface of the cylindrical body and adapted to mate with the first thread, to removably secure the cap to the neck and to hold the frangible projection flat against the outer surface of the neck, and a gap in a particular segment of the second thread, at a location that is slightly above, as measured along either helical thread when the cap is fully threaded onto the neck, the location of the frangible outward projection;

whereby, when the cap after having been substantially fully threaded onto the bottle is slightly unscrewed therefrom, the frangible outward projection enters the gap in the second thread, tending to obstruct removal of the cap, and is torn off by the second thread in the course of continuing forcible removal of the cap from the bottle.

8. The combination of claim 7, further comprising:

a second outward projection from the neck, said outward projection being:

immediately above or below a particular segment of the helical thread, at a location that corresponds, when the cap is substantially fully threaded onto the bottle, to the location of the gap in the second thread, whereby the second outward projection enters the gap in the inwardly projecting thread, when the cap is substantially fully threaded onto the bottle, and forms an obstruction to removal of the cap from the bottle, but substantially nonfrangible under application of removal torque sufficient to deform the cap and neck slightly and thereby to overcome the obstruction and to unscrew the cap from the bottle;

whereby the second outward projection tends to prevent removal of the cap from the bottle by persons unable to apply adequate torque; and whereby the first outward projection is torn off during removal of the cap from the bottle by persons able to apply adequate torque, to render evident the fact that removal has occurred.

9. The combination of claim 8, also comprising:

means defined in the cap for accommodating a tool to facilitate forcible removal of the cap from the bottle.

10. The combination of claim 8, wherein:

the second outward projection is immediately above or below, and near the lower end of, the first helical thread; and the gap in the second thread is near the lower end of the second thread.

11. In combination for use in containing products:

a bottle that is adapted to contain such products and that has:

a neck, a generally helical outwardly projecting first thread defined in the outer surface of the neck, and a gap in a particular segment of the first thread, near the lower end thereof as measured along the first thread; and a cap that is adapted to block passage of such products from the bottle, and that has:

a generally cylindrical body, an end wall closing the upper portion of the cylindrical body, a generally helical inwardly projecting second thread defined in the inner surface of the cylindrical body and adapted to mate with the first thread, to removably secure the cap to the neck, and a thin, frangible and conspicuous inward projection from the inner surface, below the lower end of the second helical thread, adapted to be folded substantially flat against the inner surface of the cylindrical body, the frangible inward projection having, when folded substantially flat against the inner surface of the cap, a tendency to spring away from the inner surface of the cylindrical body toward a more projecting orientation, the cap being adapted, when threaded onto the neck, to capture the frangible projection between the inner surface of the cylindrical body and the outer surface of the neck, and thereby to hold the frangible projection substantially flat against those two surfaces, and the frangible projection being at a location that is slightly below, as measured along either helical thread when the cap is fully threaded onto the neck, the location of the gap in the first helical thread, whereby, when the cap after having been substantially fully threaded onto the bottle is slightly unscrewed therefrom, the frangible projection enters the gap in the first thread, tending to obstruct removal of the cap, and is torn off by the first thread in the course of continuing forcible removal of the cap from the bottle.

12. The combination of claim 11, further comprising:

a second inward projection from the inner surface of the cylindrical body, said second inward projection being:

immediately above or below a particular segment of the second helical thread, at a location that corresponds, when the cap is substantially fully threaded onto the bottle, to the location of the gap in the first thread, whereby the second inward projection enters the gap in the first thread, when the cap is substantially fully threaded onto the bottle, and forms an obstruction to removal of the cap from the bottle, but substantially nonfrangible under application of removal torque sufficient to deform the cap and neck slightly and thereby to overcome the obstruction and to unscrew the cap from the bottle;

whereby the second inward projection tends to prevent removal of the cap from the bottle by persons unable to apply adequate torque; and whereby the first inward projection is torn off during removal of the cap from the bottle by persons able to apply adequate torque, to render evident the fact that removal has occurred.

13. The combination of claim 12, also comprising:

means defined in the cap for accommodating a tool to facilitate forcible removal of the cap from the bottle.

* * * * *